US012595984B2

(12) United States Patent
Miller et al.

(10) Patent No.: US 12,595,984 B2
(45) Date of Patent: Apr. 7, 2026

(54) GUN MUZZLE SOUND SUPPRESSOR

(71) Applicants: Ronald E. Miller, Wichita, KS (US); Shawna A. Miller, Wichita, KS (US)

(72) Inventors: Ronald E. Miller, Wichita, KS (US); Shawna A. Miller, Wichita, KS (US)

( * ) Notice: Subject to any disclaimer, the term of this patent is extended or adjusted under 35 U.S.C. 154(b) by 118 days.

(21) Appl. No.: 18/206,207

(22) Filed: Jun. 6, 2023

(65) Prior Publication Data

US 2023/0314098 A1 Oct. 5, 2023

Related U.S. Application Data

(63) Continuation-in-part of application No. 16/951,292, filed on Nov. 18, 2020, now abandoned.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/325
USPC ..... 181/223; 89/14.4
See application file for complete search history.

(56) References Cited

U.S. PATENT DOCUMENTS 2,499,428 A * 3/1950 Belle ..... F41A 21/36 89/14.3
5,029,512 A * 7/1991 Latka ..... F41A 21/30 89/14.4
6,374,718 B1 * 4/2002 Rescigno ..... F41A 21/30 89/14.4
8,844,422 B1 * 9/2014 Klett ..... F41A 21/34 89/14.4
10,222,162 B2 * 3/2019 Adamson, Jr. ..... F41A 21/30
10,619,962 B1 * 4/2020 Hatfield ..... F41A 21/44
10,634,445 B1 * 4/2020 Klett ..... F41A 21/30
10,746,491 B2 * 8/2020 Garst ..... F41A 21/30
10,753,699 B2 * 8/2020 Klett ..... F41A 21/30
11,656,049 B2 * 5/2023 Young ..... F41A 21/30 89/14.4
2018/0135932 A1 * 5/2018 Tomczak ..... F41A 21/30
2019/0093973 A1 * 3/2019 Hamby ..... F41A 21/30
2020/0173750 A1 * 6/2020 Riley ..... F41A 21/30

* cited by examiner

*Primary Examiner* — Forrest M Phillips
*Assistant Examiner* — Jennifer B Olson
(74) *Attorney, Agent, or Firm* — Kenneth H. Jack; Davis & Jack, L.L.C.

(57) ABSTRACT

A gun muzzle sound suppressor including a plurality of segments, wherein each segment among the plurality of segments including a cylindrical housing having an inner surface and an outer surface, wherein the each segment further includes a conical baffle fixedly attached to the inner surface of the each segment's cylindrical housing, wherein the each segment further includes a plurality of vanes fixedly attached to the outer surface of the each segment's cylindrical housing; an outer housing having an inner surface, wherein the outer housing is fitted for sliding receipts of the segments, wherein upon the receipts of the segments, the vanes contact the outer housing's inner surface; and a pair of rings fixedly attached to the outer housing, one the rings among the pair of rings being positioned muzzlewardly from a muzzleward-most segment among the plurality of segments, the other ring among the plurality of rings being positioned breachwardly from a breachward-most segment among the plurality of segments.

7 Claims, 6 Drawing Sheets

GUN MUZZLE SOUND SUPPRESSOR

REFERENCE TO AND CLAIM OF BENEFIT OF PREVIOUSLY FILED U.S. PATENT APPLICATION

This application constitutes a continuation in part pursuant to 37 CFR 1.78(d) and 37 CFR1.53(b) (2) of U.S. patent application Ser. No. 16/951,292, entitled "Gun Muzzle Sound Suppressor" and filed in the USPTO on Nov. 18, 2020. The benefit of and priority from said '292 application are hereby claimed. The inventors and applicants of said '292 application and those of the instant continuation in part application are the same. This continuation in part application is filed during the pendency of, and prior to any abandonment of said '292 application.

FIELD OF THE INVENTION

This invention relates to gun and rifle sound suppressors or silencers. More particularly, this invention relates to such sound suppressors or silencers which incorporate special configurations of and arrangements of interior blast reflecting and channeling baffles.

BACKGROUND OF THE INVENTION

Variously configured gas reflecting and channeling baffles and partitions are known to be mounted within the typically cylindrical hollow interior of a gun muzzle sound suppressor. Many known configurations of such baffles provide a marginal or deficient level of sound suppression. The instant inventive gun muzzle sound suppressor achieves enhanced and superior levels of sound suppression by providing specially configured bell or cone shaped baffles and by uniquely arranging such baffles in a linear series of segments within the suppressor's hollow interior.

BRIEF SUMMARY OF THE INVENTION

The instant inventive sound suppressor device or implement is intended to serve as or function as an attachable and detachable auxiliary component of a pistol, a revolver, or a rifle. In a preferred embodiment, the instant inventive sound suppressor provides female helical threads at its breechward end for easy attachments to and detachments from a firearm's externally helically threaded muzzle. Such female threads constitute a gun muzzle attachment adapter.

A major structural component of the instant inventive gun muzzle sound suppressor comprises a plurality of or series of bell configured baffles which are also referred to herein as bells. In a preferred embodiment, such plurality of bells comprises a breechward-most bell and at least a second bell which is held at a longitudinally adjacent position with respect to the breechward-most bell. The breechward-most bell, in combination with the at least second bell, forms a linear bell series, such series extending muzzlewardly along the suppressor's central longitudinal axis.

In a preferred embodiment, each of the bell components of the inventive suppressor includes a relatively narrow throat opening at its breechward end and includes a relatively wide mouth opening at its muzzleward end. The throat of the at least second bell preferably extends breechwardly into the mouth of the breechward-most bell, and each bell necessarily has an annular wall which extends circumferentially about the suppressor's central longitudinal axis. Bullets fired through the suppressor pass successively through the bells' throats and mouths to emit at a muzzle opening.

The radially outer surface of the circumferentially extending wall of the breechward-most bell is preferably bowed radially inwardly and muzzlewardly so that such surface approximates a geometric shape selected from the group consisting of obverted ellipsoid surfaces, obverted paraboloid surfaces, and hyperboloid surfaces.

In contrast with the radially inwardly and muzzlewardly bowed radially outer surface of the breechward-most bell, the radially outer surface of the at least second bell is suitably substantially conic, such surface being configured as a portion of the surface of a geometric cone.

In the preferred embodiment, the suppressor further comprises a plurality of third bells which extends muzzlewardly in a linear series from the at least second bell. Each bell among the plurality of third bells is preferably configured substantially identically with the at least second bell.

A further structural component of the instant inventive gun muzzle sound suppressor comprises a first cylindrical housing or a radially inner cylindrical housing. In the preferred embodiment, the series of bells is securely and fixedly mounted within a hollow interior space defined by such radially inner cylindrical housing. Also in such embodiment, each bell is formed wholly with such inner cylindrical housing, the bells' annular mounts or supports residing at the peripheral edges or lips of the bells' mouths.

The radially inner cylindrical housing is preferably longitudinally segmented, and each bell's wholly formed connection with such housing preferably resides at one of such segments. Where the radially inner housing includes the preferred segmentation, a second housing or radially outer housing is preferably provided, such outer housing slidably receiving and supporting a longitudinally stacked array or series of the inner housing's segments. The inner housing's segments preferably further comprise pluralities of helical vanes. Such vanes are preferably fixedly attached to and extend radially outwardly from the outer surfaces of the radially inner housing segments. Such vanes form helical gas passage channels residing between the inner and outer housings. Radially outer ends of the helical vanes preferably contact the inner surface of the outer housing, allowing the vanes to securely and substantially centrally mount the inner housing's segments within the hollow interior of the outer housing.

Each of the inner housing's segments necessarily has a longitudinal end and a breachward end, and in such stacked array or series, such ends abut or contact each other, the points of abutting contact constituting or forming annular seam components of the inner housing.

In operation of the instant inventive gun muzzle sound suppressor, a bullet may be fired from an attached weapon, such bullet passing longitudinally and muzzlewardly through the bells' throat and mouth openings. A portion of the expanding volume of gas following the bullet's passage initially impinges against the bowed radially outer surface of the breechward-most bell, and the remaining portions of such gas pass muzzlewardly through the throat of the breechward-most bell. Such remaining portions of the gas successively impinge against the substantially conic radially outer surfaces of the suppressor's muzzleward series of bells.

A reconfiguration of the instant invention's bells to alternatively breechwardly position one of the conic bells has been observed to produce a suppressor which performs markedly less effectively in terms of sound suppression. The preferred embodiment of the instant invention produces enhanced gun muzzle sound suppression by radially inwardly and muzzlewardly bowing the radially outer surface of the circumferentially extending wall of the breechward-most bell, and by conically configuring the radially outer surfaces of the muzzlewardly successive bells within the suppressor.

The segmented configuration of the suppressor's inner housing component advantageously allows an operator to select the number of segments and baffles which will be slidably received within the outer housing.

Accordingly, objects of the instant invention include the provision of a gun muzzle sound suppressor which incorporates structures as described above, and which arranges those structures in manners described above for the achievement of beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
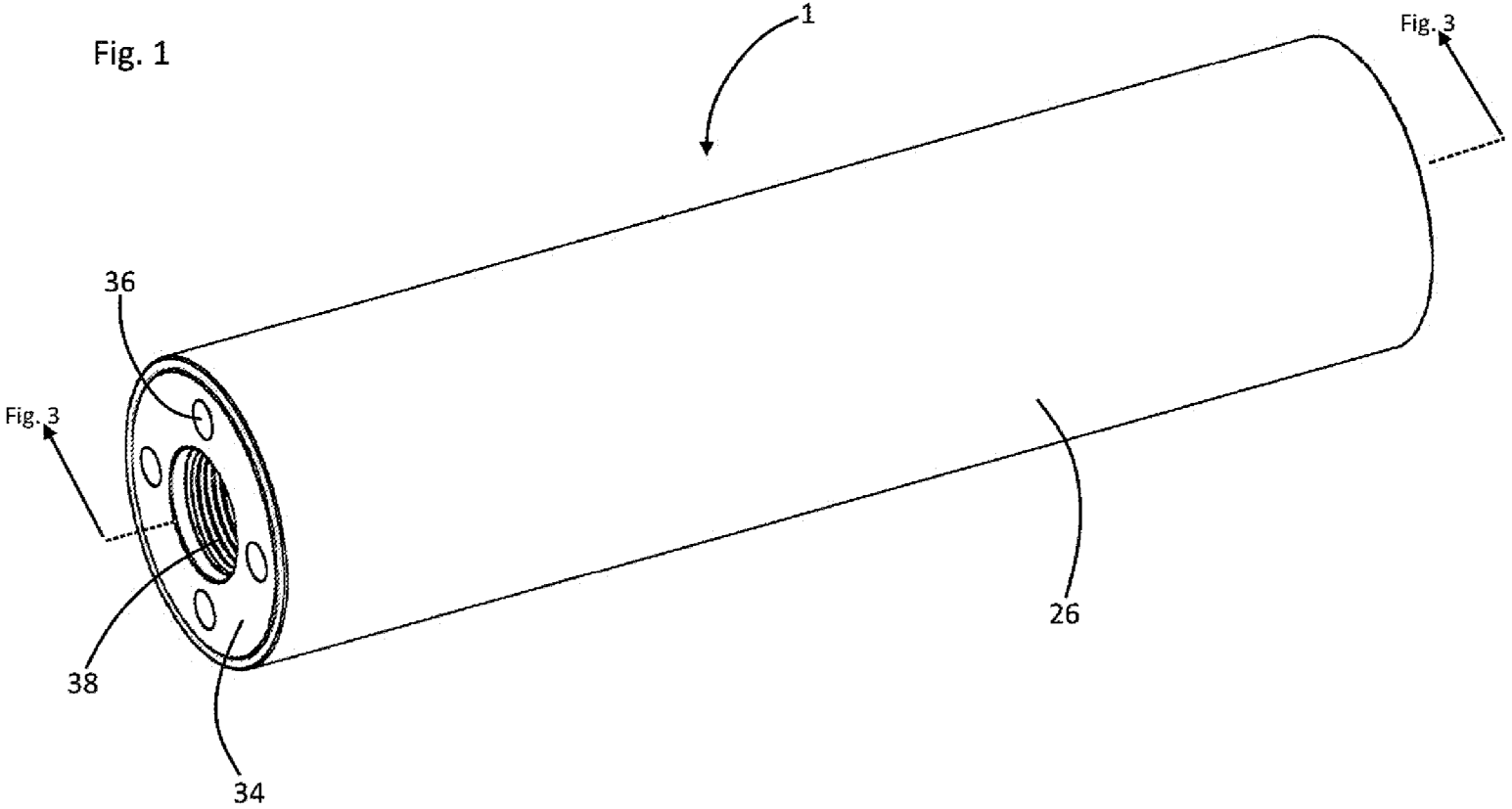
FIG. 1 is a perspective view of a preferred embodiment of the instant inventive gun muzzle sound suppressor.
Figure 2:
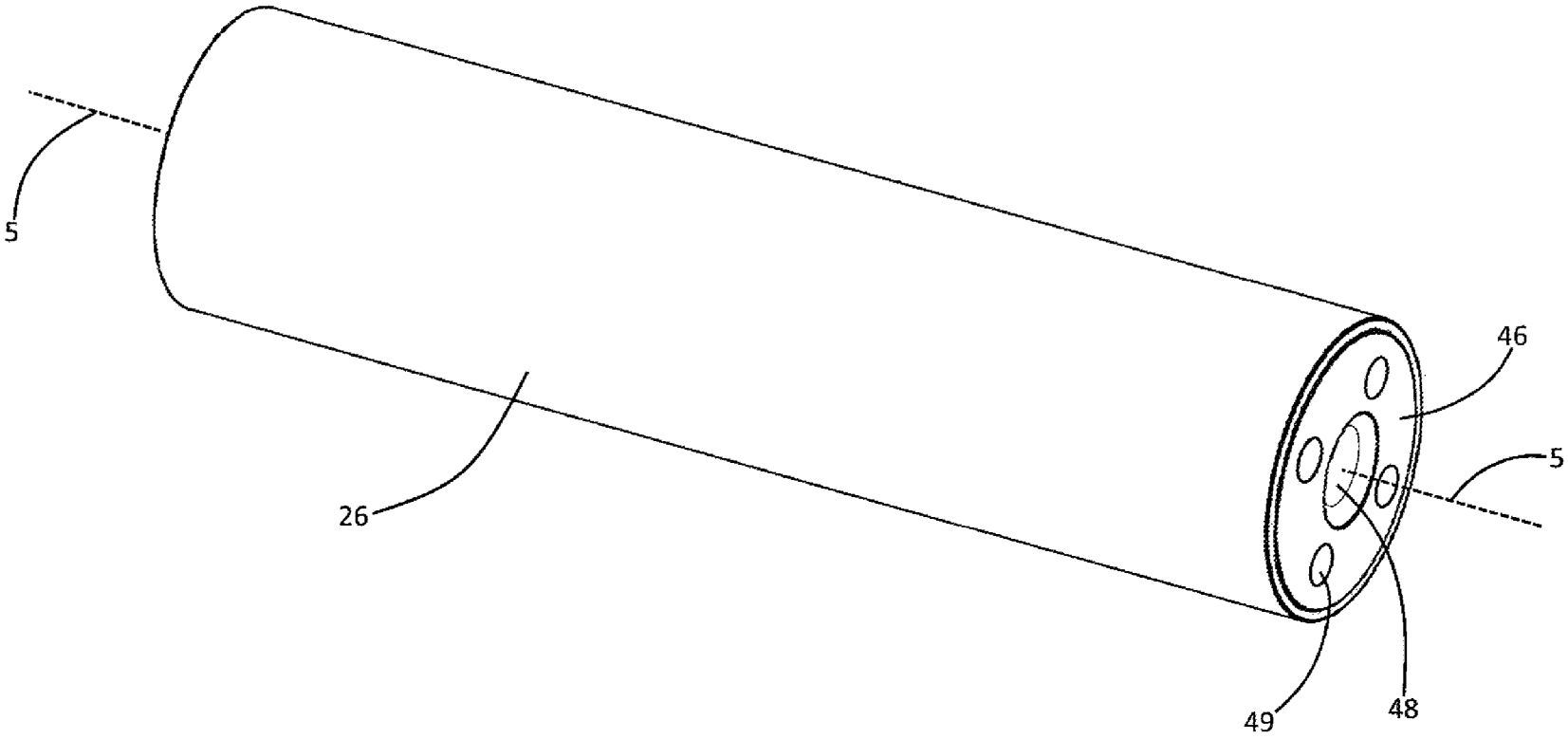
FIG. 2 is an alternative perspective view of the structure of FIG. 1.
Figure 3:
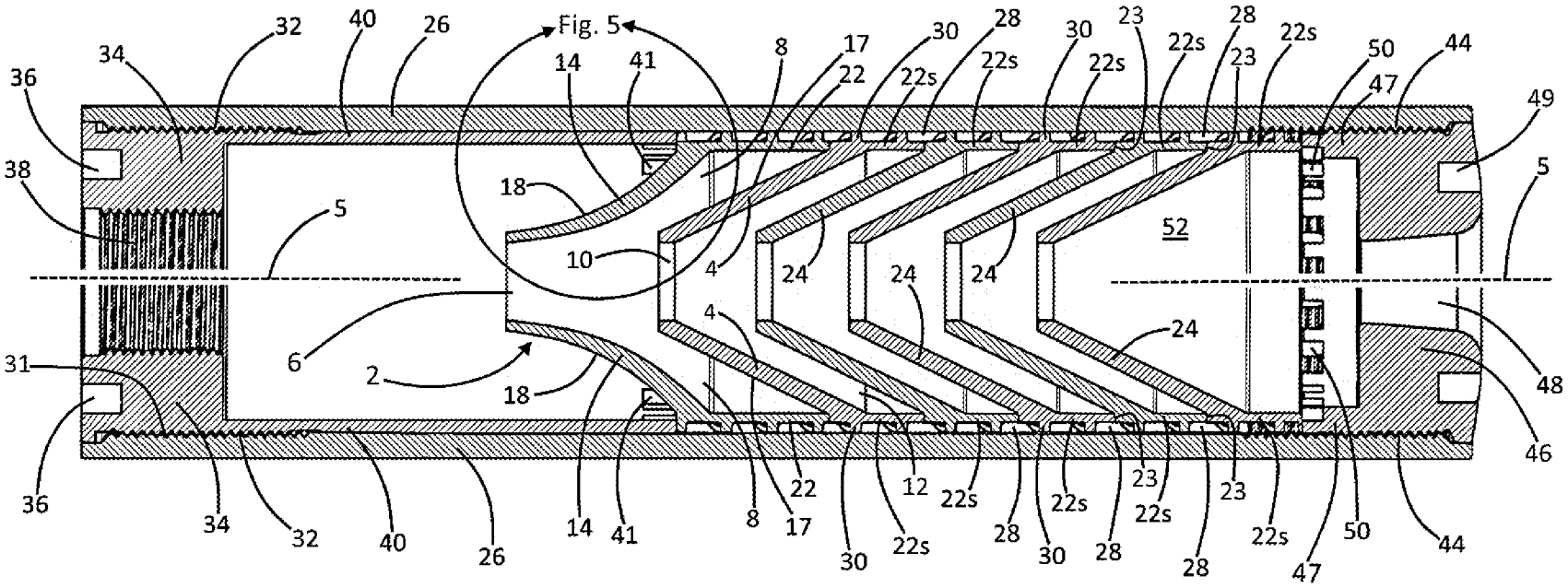
FIG. 3 is a sectional view as indicated in FIG. 1.
Figure 4:
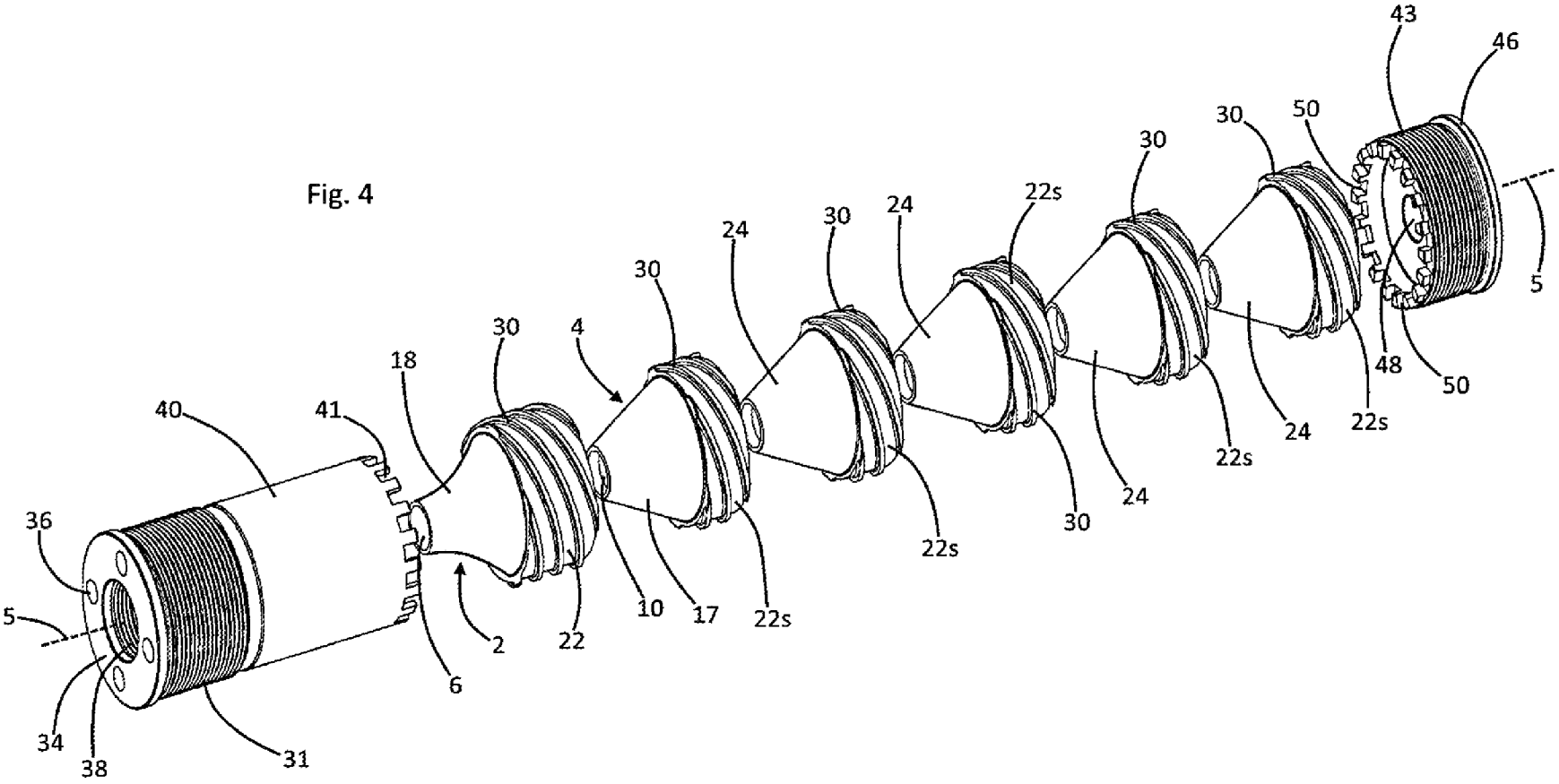
FIG. 4 is an exploded view of interior components of the FIGS. 1-3 structure.

Referring now to the drawings, and in particular to Drawing FIG. 1, a preferred embodiment of the instant inventive gun muzzle sound suppressor is referred to generally by Reference Arrow 1. Referring further simultaneously to FIGS. 3 and 4, further structural components of the instant inventive gun muzzle sound suppressor comprise a plurality of bells, bell configured vanes, or conical baffles, such plurality of structures comprising, at a minimum, a breechward-most bell which is referred to in FIG. 3 generally by Reference Arrow 2. A second muzzlewardly adjacent bell is referred to generally by Reference Arrow 4. Such bell or conical baffle components have relatively narrow and breechward throat openings 6 and 10, and have larger or wider muzzleward mouth openings 8 and 12. As is particularly shown in FIG. 3, the throat opening 10 of the at least second bell 4 extends or nests breechwardly into the mouth 8 of the breachward-most bell 2.

Figure 5:
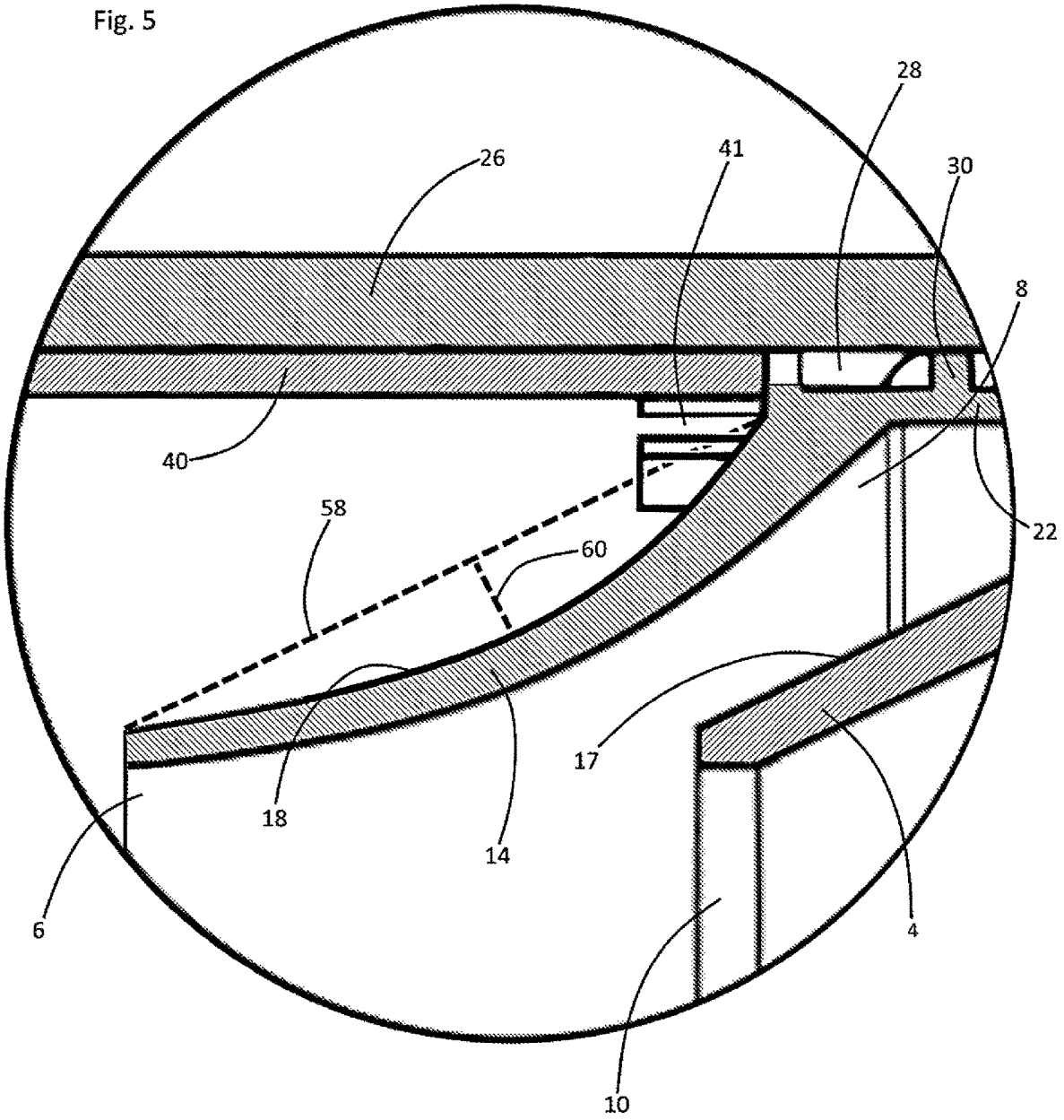
FIG. 5 is a partial magnified view of a portion of the structure of FIG. 3, as indicated in FIG. 3.

Referring to FIGS. 3 and 5, the breechward-most bell 2 has an annular wall 14 which extends circumferentially about a longitudinal axis of the suppressor, such axis being designated by dashed line 5. In the preferred embodiment, such circumferentially extending wall 14 is bowed radially inwardly and muzzlewardly so that its radially outer surface 18 forms a geometric shape which approximates an obverted ellipsoid surface, an obverted paraboloid surface, or a hyperboloid surface.

Referring in particular to FIG. 5, the radially outer surface 18 of the circumferentially extending wall 14 of the breachward most breechward-most bell 2 has a length dimension along dashed line 58, such dimension extending radially outwardly from and muzzlewardly from the periphery of throat 6. Such surface 18 suitably bows radially inwardly and muzzlewardly from such line 58 to a bow depth 60. In the preferred embodiment, the breachward mest breechward-most bell's bow depth 60 is adjusted or tailored to be between 1/12 and 1/6 of length 58.

In contrast with the concavely bowed outer surface 18 of the breechward-most bell or cone 2, the suppressor's at least second bell 4 has a radially outer surface 17 which is configured as a portion of the surface of a regular geometric cone.

A further structural component of the instant inventive gun muzzle sound suppressor comprises at least a first cylindrical housing or radially inner housing whose multiple segments are designated by Reference Numerals 22 and **22*s*. As can be seen in FIGS. 3 and 4, individual segments of the cylindrical housing 22 and 22*s*** abuttingly meet each other at their muzzleward and breechward ends, such abutting end contacts forming annularly extending seam components of the inner cylinder.

For purposes of example and explanation, two of such seam components are specifically identified in FIG. 3 by lead lines extending from reference numerals 23. Said seams 23 operate to divide the radially inner cylindrical housing 22,**22*s*** into a longitudinally extending series of segments. In the preferred embodiment, the base end or muzzleward end of each bell or conically configured baffle is fixedly attached to or formed wholly with one of such inner cylindrical housing segments, such attachment being annular and making each such baffle an integral component of one of the inner housing's segments.

A plurality of third bell configured or conical baffles 24 is preferably provided, such third bells being arranged in a muzzlewardly extending or longitudinally extending linear series, such series extending from the at least second bell 4. In the preferred embodiment, each bell 24 among the plurality of third bells is configured substantially identically with the at least second bell 2. The further segments **22*s* of the at least first cylindrical housing incorporate and provide individual or one to one mounting support to such third bells 24**.

Where the at least first cylindrical housing 22,**22*s* includes the preferred linear series of segments, a second or radially outer housing 26 is preferably provided. Such outer housing 26 advantageously nestingly receives and supports the segments which comprise the inner cylindrical housing 22,22*s*. In the preferred embodiment, the inside diameter of the second or outer cylindrical housing 26 is greater than the outside diameter of the first cylindrical housing 22,22*s*, such differential in diameters advantageously creating a gas passage annulus 28** therebetween.

In a preferred embodiment, a multiplicity of gas channeling vanes or baffles 30 are disposed within the gas passage annulus 28, such vanes preferably both extending helically about the longitudinal axis 5 and extending along the outer housing's inner surface. In such embodiment, radially inner bases of the helical vanes 30 are formed wholly with or constitute continuations of the segments of the inner cylindrical housing 22,**22*s*. Where such vanes 30 are provided, they constitute components of the he radially inner housing and of such housing's segments 22 and 22*s***.

Referring simultaneously to FIGS. 3 and 4, to facilitate ease of assembly of the instant inventive sound suppressor, internal helical threads 44 are provided at the muzzleward end of the second or radially outer cylindrical housing 26. A blast choking ring 46 having mating external helical threads 43 and having a central muzzle aperture 48 may be initially screwed in place within the outer housing 26 as indicated in FIG. 3. Wrench jaw engaging sockets 49 may be utilized to assist in screw installation of the ring 46. Such ring 46 preferably includes and presents a breechwardly extending shoulder 47, the extreme breachward end of which includes a multiplicity of gas passage slots 50.

Following a threaded installation of the blast choking ring 46, as indicated in FIG. 3, the plurality of inner cylindrical housing segments, which include and incorporate the third bells 24, the at least second bell 4, the breechward-most bell 2, and the helical vanes 30, may be successively slidably inserted into the open breechward end of the outer housing 26. Following such inner housing segment insertions, the segments may freely slide muzzlewardly to assume the longitudinal series configuration depicted in FIG. 3. During such segment insertions, the radially outer ends of the vanes 30 travel in sliding contact with the inner surface of the outer housing 26.

Following such inner housing segment insertions, the segments may freely slide muzzlewardly to assume the longitudinal series configuration depicted in FIG. 3. During such segment insertions, the radially outer ends of the vanes 30 travel in sliding contact with the inner surface of the outer housing 26.

Upon achieving series configuration of the inner housing's segments, the radially outer ends of the vanes 30 continue to contact the inner surface of the outer housing 26, such contacts securely centrally positioning the segments within the hollow space of the outer housing 26.

Thereafter, a muzzleward portion of a provided ring configured gun muzzle adapter 34 may be initially slidably inserted muzzlewardly into the breechward opening of housing 26. To facilitate further mounting of the gun muzzle adapter 34, the breechward end of the housing 26 presents helical threads 32 which are gauged to mate with external helical threads 31 formed about the gun muzzle adapter 34. A muzzleward extension sleeve component 40 of the gun muzzle adapter 34 includes a multiplicity of gas passage slots 41 which function similarly with slots 50 at the muzzle end of the suppressor. Upon screw tightening of the gun muzzle adapter 34 by engagement of a wrench (not depicted within views) with wrench jaw sockets 36, the extreme muzzleward end of the gun muzzle adapter 34 advantageously presses the series of bells 2, 4, and 24 muzzlewardly against the shoulder 47 of the blast choking ring 46.

As a final assembly step, the suppressor 1 may be screwed onto a muzzle of a firearm (not depicted within views) through use of muzzle mounting screw threads 38. Helical threads 38 are commonly right handed in order to match common right handed threads which are applied to silencer adapted gun muzzles. Where threads 38 are right handed, threads 31, 32, 43, and 44 are preferably left handed so that threaded detachment of the suppressor 1 from such gun muzzle will not unscrew the threaded mounts of the adapter 34 and the ring 46.

In operation of the instant inventive sound suppressor, referring simultaneously to FIGS. 1-5, a fired bullet may initially traverse the hollow interior space defined by the extension sleeve component 40 of the muzzle adapter 34. Thereafter, such bullet successively passes through throat openings 6 and 10, then passing through the throat opening of each of the third cones 24. Such bullet finally traverses a conical space 52 within the suppressor's muzzleward-most bell, and exits through muzzle opening 48.

Immediately following the muzzleward passage of such bullet, a substantial portion of blast gases may impinge against the radially inwardly and muzzlewardly bowed outer surface 18 of the breechward-most bell 2. A portion of such impinging gases reflects breechwardly while another portion of such gases continues muzzlewardly, passing through slots 41.

Blast gases which are shunted through slots 41 travel circumferentially, muzzlewardly, and helically along the annulus 28, the movement of such gas being dampened or buffered by the helically extending baffles 30. At the extreme muzzleward end of the annulus 28, and at the extreme muzzleward ends of the helical channels formed by vanes 30, such shunted portion of the expanding gas finally passes radially inwardly through slots 50 to emerge into the suppressor's final or muzzleward conical space 52. Such gases may then emit through muzzle opening 48. Accordingly, the annulus 28 and helical baffles 30 function as a gas pressure relief shunt or bypass which advantageously reduces breechward reflections of gases at bell surfaces 18 and 17. Such reduction of breechward reflection of gas beneficially minimizes the tendency of such reflected gases to interfere with a mechanically automated cartridge chambering function which may commonly be performed by the weapon's breach mechanism.

A separate portion of the expanding gas which explosively follows the above-described fired bullet may initially pass through the suppressor's most breechward-most throat opening 6, such gas thereafter impinging against the conical surface 17 of the at least second bell 4. Successively diminishing portions of such expanding gases pass through the throats of the third bells 24 to impinge against next successive conical radially outer surfaces.

The pressure and velocity of the bullet trailing gas which finally enters space 52 via combined passages through annulus 28 and through the throats of the bells is low and is markedly reduced. Accordingly, the instant inventive suppressor effectively reduces blast sounds emitting from muzzle opening 48 while minimizing breachward reflections of gas along the bore of the weapon's barrel.

Figure 6:
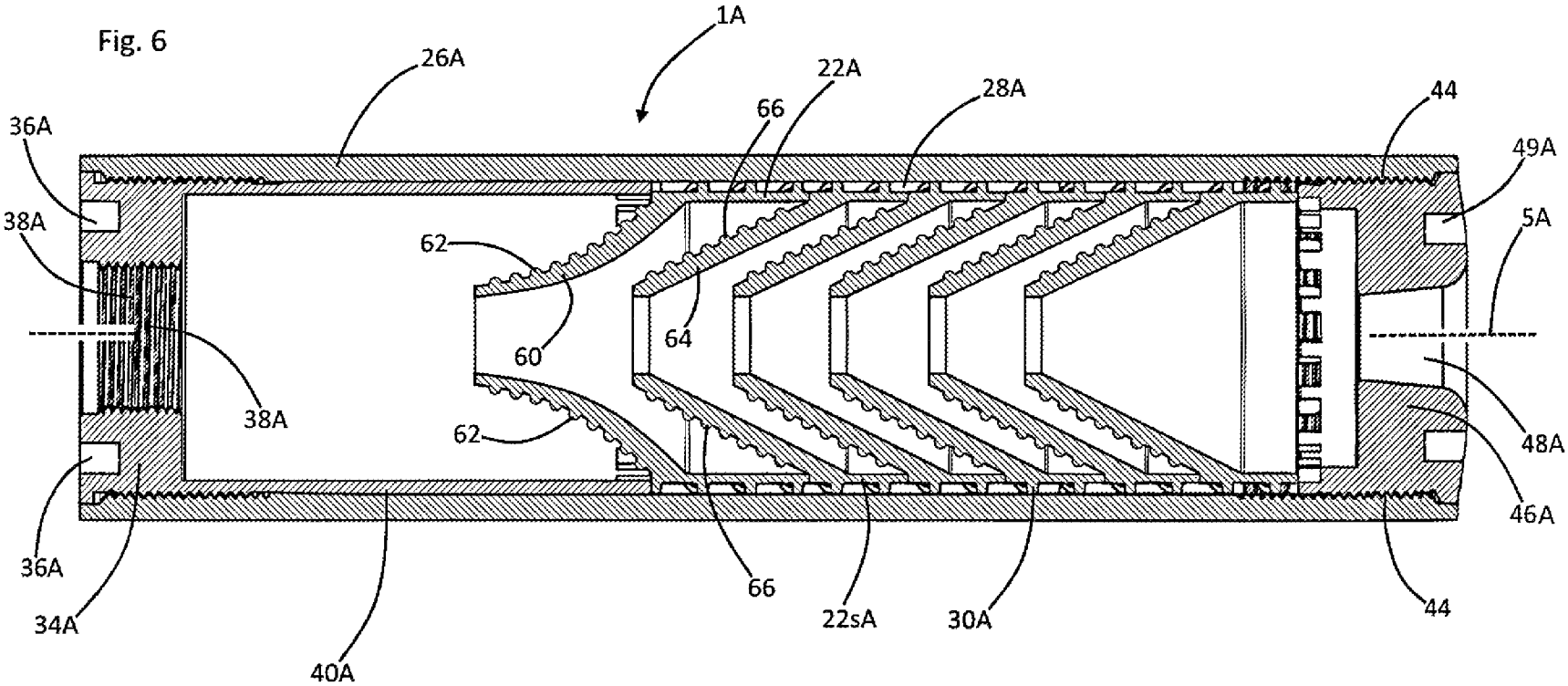
FIG. 6 presents an alternative configuration of the FIG. 3 structure.

Referring to the alternative configuration of Drawing FIG. 6, all structures identified by a reference numeral having the suffix "A" are configured substantially identically with similarly numbered structures appearing in Drawing FIGS. 1-5. In the FIG. 6 structural alternative, a plurality of circumferentially extending knurls or ridges 62 is presented at the radially outer surface of the breechward bell 60. Similar circumferentially extending knurls 66 are presented at the conic radially outer surface of the at least second bell 64. Such knurls 62 and 66 operate to reduce breechward reflection of muzzle blast gases. Where such pluralities or multiplicities of knurls are provided, the radially outwardly and breechwardly extended apexes of such knurls are recognized as constituting the invention's bowed or conic surfaces.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A gun muzzle sound suppressor comprising:

(a) a plurality of segments, wherein each segment among the plurality of segments comprises a cylindrical housing having an inner surface, an outer surface, a breechward end, and a muzzleward end, wherein said each segment further comprises an inner vane configured as a bell, said inner vane being fixedly attached to the inner surface of said each segment's cylindrical housing, wherein said each segment further comprises a plurality of outer vanes fixedly attached to the outer surface of said each segment's cylindrical housing, wherein each outer vane among said plurality of outer vanes has a breechward end coinciding with the breechward end of one of the segments' cylindrical housings, wherein said each outer vane has a muzzleward end coinciding with the muzzleward end of said one of the segments' cylindrical housings, and wherein said each outer vane extends helically from its breechward end to its muzzleward end;

(b) an outer housing having an inner surface, wherein the outer housing is fitted for sliding receipts of the segments, wherein upon said receipts of the segments, the plurality of outer vanes contact the outer housing's inner surface;

(c) a pair of rings fixedly attached to the outer housing, wherein one of the rings among said pair of rings comprises a shoulder having a breechward end, said shoulder being positioned muzzlewardly from a muzzleward-most segment among the plurality of segments, the other ring among said pair of rings being positioned breechwardly from a breechward-most segment among the plurality of segments;

(d) a multiplicity of of helical gas passage channels, wherein each helical gas passage channel among the multiplicity of helical gas passage channels resides between one of the segments' cylindrical housings and the outer housing, and wherein a plurality of channels among the multiplicity of helical gas passage channels resides between said muzzleward-most segment and the outer housing; and (e) a plurality of inwardly opening slots within the breechward end of the shoulder, wherein each inwardly opening slot is adapted to inwardly channel gas from one of the gas passage channels among the plurality of gas passage channels.

2. The gun muzzle sound suppressor of claim 1 wherein the other ring among said pair of rings comprises a gun muzzle mounting adapter.

3. The gun muzzle sound suppressor of claim 2 further comprising a plurality of segment dividing seams, wherein at least one of the ends among said cylindrical housing's breechward and muzzleward ends resides at one of the segment dividing seams.

4. The gun muzzle sound suppressor of claim 3 wherein the helical gas passage channels extend along the outer housing's inner surface.

5. The gun muzzle sound suppressor of claim 4 comprising helical threads operatively presented at the outer housing's breechward and muzzleward ends, said helical threads engaging mating helical threads presented at the pair of rings.

6. The gun muzzle sound suppressor of claim 5 wherein each bell configured inner vane has breechward opening and a muzzleward opening, and wherein said each bell configured inner vane's muzzleward opening is larger than said each bell configured inner vane's breechward opening.

7. The gun muzzle sound suppressor of claim 6 wherein the breechward opening of at least a first bell configured inner vane among the segments' bell configured inner vanes extends breechwardly into another bell configured inner vane's muzzleward opening.

* * * * *